US009431159B2

(12) United States Patent
Rowe et al.

(10) Patent No.: US 9,431,159 B2
(45) Date of Patent: Aug. 30, 2016

(54) IRON COBALT TERNARY ALLOY NANOPARTICLES WITH SILICA SHELLS AND METAL SILICATE INTERFACE

(71) Applicant: TOYOTA MOTOR ENGINEERING & MANUFACTURING NORTH AMERICA, INC., Erlanger, KY (US)

(72) Inventors: Michael Paul Rowe, Pinckney, MI (US); Ryan Daniel Desautels, Winnipeg (CA)

(73) Assignee: Toyota Motor Engineering & Manufacturing North America, Inc., Erlanger (KY)

( * ) Notice: Subject to any disclaimer, the term of this patent is extended or adjusted under 35 U.S.C. 154(b) by 0 days.

(21) Appl. No.: 14/521,063

(22) Filed: Oct. 22, 2014

(65) Prior Publication Data

US 2015/0255199 A1 Sep. 10, 2015

Related U.S. Application Data

(60) Provisional application No. 61/948,276, filed on Mar. 5, 2014.

(51) Int. Cl.

| | |
|---|---|
| ***H01F 1/33*** | (2006.01) |
| ***H01F 41/00*** | (2006.01) |
| ***H01F 1/00*** | (2006.01) |

(52) U.S. Cl.
CPC ..... *H01F 1/33* (2013.01); *H01F 1/0054* (2013.01); *H01F 41/005* (2013.01)

(58) Field of Classification Search
None
See application file for complete search history.

(56) References Cited

U.S. PATENT DOCUMENTS

| | | | | |
|---|---|---|---|---|
| 6,051,324 | A * | 4/2000 | Moorhead | H01F 1/24 428/403 |
| 2011/0098453 | A1* | 4/2011 | Hyeon | B82Y 5/00 530/415 |
| 2013/0342069 | A1 | 12/2013 | Rowe | |
| 2014/0027667 | A1 | 1/2014 | Rowe | |
| 2014/0035713 | A1 | 2/2014 | Rowe | |
| 2014/0346389 | A1 | 11/2014 | Rowe | |
| 2014/0375403 | A1 | 12/2014 | Rowe | |

OTHER PUBLICATIONS

Yan et al. (The influence of Fe content on the magnetic and electromagnetic characteristics for Fex(CoNi)1-x ternary alloy nanoparticles, Journal of Applied Physics. 109, 07A320 (2011)).*
Sperling et al. (Surface modification, functionalization and bioconjugation of colloidal inorganic nanoparticles, Phil. Trans. R. Soc. A (2010) 368, 1333-1383).*
U.S. Appl. No. 14/270,619, filed May 6, 2014, Rowe, et al.
U.S. Appl. No. 14/270,752, filed May 6, 2014, Rowe, et al.
U.S. Appl. No. 14/252,036, filed Apr. 14, 2014, Rowe, et al.
U.S. Appl. No. 14/296,917, filed Jun. 5, 2014, Rowe, et al.
U.S. Appl. No. 13/942,116, filed Jul. 15, 2013, Rowe, et al.

* cited by examiner

*Primary Examiner* — Alexandre Ferre
(74) *Attorney, Agent, or Firm* — Oblon, McClelland, Maier & Neustadt, L.L.P.

(57) ABSTRACT

Superparamagnetic core-shell nanoparticles having a core of an iron cobalt ternary alloy, a shell of a silicon oxide on the core and a metal silicate interface layer between the core and the shell layer are provided. Methods to prepare the nanoparticles are also provided.

19 Claims, 4 Drawing Sheets

IRON COBALT TERNARY ALLOY NANOPARTICLES WITH SILICA SHELLS AND METAL SILICATE INTERFACE

CROSS REFERENCE TO RELATED APPLICATIONS

This application claims priority to U.S. Application No. 61/948,276, filed Mar. 5, 2014, the disclosure of which is incorporated herein by reference in its entirety.

BACKGROUND OF THE INVENTION

1. Field of the Invention

This invention is directed to novel coated superparamagnetic alloy nanoparticles and methods to prepare such materials. In particular, the invention is directed to silica coated iron cobalt ternary alloy nanoparticles having a metal silicate layer interfacing the metal alloy and the silica coating.

2. Discussion of the Background

Iron cobalt alloys are conventionally utilized in the construction of magnetic cores of motors, generators and transformers. Conventionally, such cores have been constructed of laminate structures of magnetic alloys, typically iron-cobalt-vanadium or iron-cobalt chromium alloys. Such laminate structures generally consist of alloy metal layers sandwiched with interlaminar insulation and binder layers. These interlaminar layers are necessary to insure high electrical efficiency of the magnetic core.

However, ever increasing demand for greater and more efficient performance of motors, generators and transformers has spurred a search for new materials with which compact magnetic cores having greatest saturation induction and little or no hysteresis loss can be constructed.

The most important characteristics of such soft magnetic core components are their maximum induction, magnetic permeability, and core loss characteristics. When a magnetic material is exposed to a rapidly varying magnetic field, a resultant energy loss in the core material occurs. These core losses are commonly divided into two principle contributing phenomena: hysteresis and eddy current losses. Hysteresis loss results from the expenditure of energy to overcome the retained magnetic forces within the core component. Eddy current losses are brought about by the production of induced currents in the core component due to the changing flux caused by alternating current (AC) conditions.

The use of powdered magnetic materials allows the manufacture of magnetic parts having a wide variety of shapes and sizes. Conventionally, however, these materials made from consolidated powdered magnetic materials have been limited to being used in applications involving direct currents. Direct current applications, unlike alternating current applications, do not require that the magnetic particles be insulated from one another in order to reduce eddy currents.

Conventionally, magnetic particles are coated with thermoplastic materials to act as a barrier between the particles to reduce induced eddy current losses. However, in addition to the relatively high cost of such coatings, the plastic has poor mechanical strength and as a result, parts made using plastic-coated particles have relatively low mechanical strength. Additionally, many of these plastic-coated powders require a high level of binder when pressed. This results in decreased density of the pressed core part and, consequently, a decrease in magnetic permeability and lower induction. Additionally, and significantly, such plastic coatings typically degrade at temperatures of 150-200° C. Accordingly, thermoplastic coated magnetic particles are of limited utility.

Conventionally, ferromagnetic powders have been employed for the production of soft magnetic core devices. Such powders are generally in a size range measured in microns and are obtained by a mechanical milling diminution of a bulk material. Superparamagnetic nanoparticle materials having particle size of less than 100 nm have found utility for magnetic record imaging, as probes for medical imaging and have been applied for targeted delivery of therapeutic agents. However, these utilities have generally been limited to superparamagnetic iron oxide nanoparticles and little effort has been directed to the development of iron-cobalt ternary alloy nanoparticles suitable for utilization in the production of core magnetic parts.

Brunner (U.S. Pat. No. 7,532,099) describes coated alloy particles which are employed with a ferromagnetic alloy powder and a thermoplastic or duroplastic polymer to prepare an injection molded or cast soft magnetic core. An alloy of Iron, copper, niobium, silicon and boron is heat treated to form a nanocrystalline structure, then comminuted in a mill to obtain particles having dimensions of about 0.01 to 1.0 mm. An abrasion resistant layer of iron and silicon oxide of 150 to 400nm is coated to the particles.

Anand et al. (U.S. Pat. No. 6,808,807) describes encapsulated ferromagnetic powders obtained by coating a ferromagnetic core with a polyorganosiloxane or polyorganosilane and thermally treating the coated core to convert the polymer to a residue containing silicon and oxygen. The core alloy may be any of iron alloyed with silicon, aluminum, nickel, cobalt, boron, phosphorous, zirconium, neodymium and carbon. Ferromagnetic core particles having an average diameter of less than 2 mm are suitable for this composition.

Gay et al. (U.S. Pat. No. 6,193,903) describes ceramic coated ferromagnetic powders. The powders are iron or an iron alloy and the encapsulating layer on the particle may be one of a group of ceramics such as a metal oxide, metal nitride, metal silicate and a metal phosphate. The particle size is from 5 to 1000 microns. Silica is listed as one of a large group of ceramic materials suitable as the coating.

Moorhead et al. (U.S. Pat. No. 6,051,324) describes particles of an alloy of iron/cobalt/vanadium having a particle size of less than 44 microns which are coated with a glass, a ceramic or a ceramic glass, including silicon dioxide.

Atarashi et al. (U.S. Pat. No. 5,763.085) describes a magnetic particle having multiple layers on its surface which is useful as a starting material for color magnetic materials such as magnetic toners. The particles are of a size from 0.01 to 200 μm. Silicon dioxide is described as a metal oxide coating along with preparation by a sol gel method. Description of preparation of a metal layer on the particle by reduction of a soluble metal salt in the presence of a complexing agent is provided.

Yamanaka et al. (U.S. Pat. No. 4,983,231) describes a surface treated magnetic powder obtained by treating an iron-rare earth metal alloy with alkali-modified silica particles. The mean particle diameter of the alloy particles is from 20 to 200 μm. Upon heating the alkali silicate dehydrates and condenses to form a "polysiloxane" coating.

Uozumi et al. (JP 2007-123703) describes application of a silicate coating to soft magnetic powders including alloys of iron, cobalt and vanadium, having a mean particle size of 70 microns. The coated particles are heat treated cause migration of Si and O into the soft magnetic core to form a diffusion zone between the outer oxide layer and the soft magnetic core.

Yamada et al. (JP 03-153838) (Abstract) describes surface treatment of an iron/cobalt/vanadium powder with a compound containing silicon and an alkoxy group (such as vinyl triethoxysilane). No description of particle size or method to produce the alloy particle is provided.

Sun et al. (J. Am. Chem. Soc., 2002, 124, 8204-8205) describes a method to produce monodisperse magnetite nanoparticles which can be employed as seeds to grow larger nanoparticles of up to 20 nm in size.

Bumb et al. (Nanotechnology, 19, 2008, 335601) describes synthesis of superparamagnetic iron oxide nanoparticles of 10-40 nm encapsulated in a silica coating layer of approximately 2 nm. Utility in power transformers is referenced, but no description of preparation of core structures is provided.

Zhang et al. (Nanotechnology, 19, 2008, 085601) describes synthesis of silica coated iron oxide particles. The average size of the iron oxide particle to be coated is 8 to 10 nm and the silica core is about 2 nm.

Hattori et al. (U.S. 2006/0283290) describe silica coated, nitrided iron particles having an average particle diameter of 5 to 25 nm. The particles are "substantially spherical" and are useful for magnetic layers such as a magnetic recording medium.

Yu et al. (J. Phys. Chem. C 2009. 113, 537-543) describes the preparation of magnetic iron oxide nanoparticles encapsulated in a silica shell. Utility of the particles as magnetic binding agents for proteins is studied.

Thus, there is a need for new magnetic powders to produce soft magnetic parts, which provide increased green strength, high temperature tolerance, and good mechanical properties and which parts have minimal or essentially no core loss.

Previous effort in this study is described in prior U.S. application Ser. No. 13/558,397, filed Jul. 26, 2012, the disclosure of which is incorporated herein by reference in its entirety. Application to magnetic cores is described in prior U.S. application Ser. No. 13/565,250, filed Aug. 2, 2012, the disclosure of which is incorporated herein by reference in its entirety.

However, there is a need for new and/or improved magnetic powders to produce soft magnetic parts, which provide increased green strength, high temperature tolerance, and good mechanical properties and which parts have minimal or essentially no core loss.

Therefore, an object of the present invention is to provide a superparamagnetic powder which has tunable magnetic properties suitable to produce soft magnetic parts, while simultaneously having increased green strength, high temperature tolerance, and good mechanical properties for the production of high performance magnetic cores.

A second object of the invention is to provide a method to prepare the powder nanoparticles of such superparamagnetic powder.

SUMMARY OF THE INVENTION

Applicant continues to direct effort and resources to the study of materials which would be useful to produce a magnetic core having the properties required for production of future high performance motors, generators and transformers. A series of core-shell FeCoV/$SiO_2$ nanoparticles were produced by a two-step chemical synthesis. The FeCoV core and metal silicate interface-phases were determined from x-ray photoelectron spectroscopy. The presence of these metal silicate-phases results in a marked increase in magnetic anisotropy (i.e. coercivity). The effect may be increased with a thicker $SiO_2$ shell that results in the formation of more metal silicate. Controlling the structure and size of this magnetically active metal silicate interface layer metal silicate interface layer may allow for tuning of the magnetic properties for utility of these materials.

Thus, the above objects and others have been achieved according to the present invention, the first embodiment of which provides a core-shell nanoparticle, comprising:

a core of an iron cobalt ternary alloy;

a shell of a silicon oxide coating the core; and a metal silicate interface in a region between the core and the shell; wherein the third component of the ternary alloy is a transition metal selected from the group consisting of scandium, titanium, vanadium, chromium, manganese, nickel, copper and zinc, a particle size of the nanoparticle is from 2 to 200 nm, and the metal silicate of the metal silicate interface comprises at least one of iron silicate, cobalt silicate and the third component transition metal silicate.

In one of the preferred embodiments according to the invention, the metal silicate interface is magnetically active.

In another of the preferred embodiments, according to the present invention the metal silicate interface comprises iron silicate, cobalt silicate and vanadium silicate.

In a further preferred embodiment, a width of the region of the interface of the core-shell nanoparticles is from 0.1 to 10 nm.

In a further embodiment, the present invention provides a method to prepare core shell nanoparticles according to the first embodiment, comprising:

dissolving each of an iron salt, a cobalt salt and a transition metal salt in an alkaline alcoholic solution to obtain a solution of the iron salt, the cobalt salt, and the transition metal salt other than iron and cobalt; treating the solution with a reducing agent to produce nanoparticles of an iron cobalt ternary alloy; coating the alloy particles with a silicon oxide shell to obtain the core shell nanoparticles; and isolating and drying the core-shell nanoparticles produced.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE INVENTION

Figure 1:
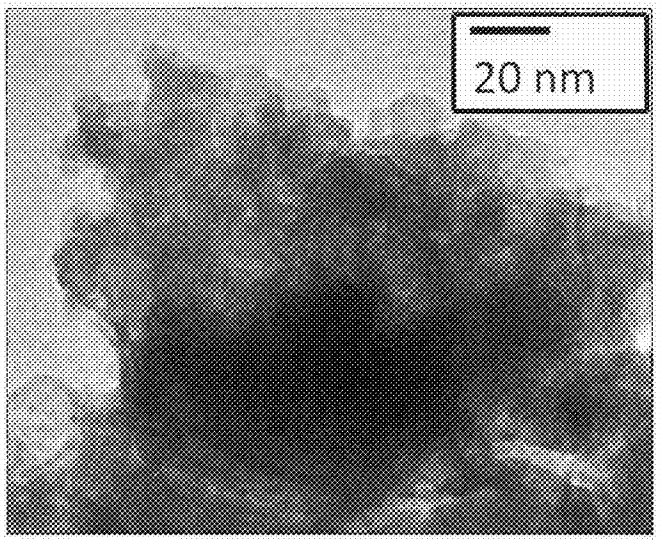
FIG. 1 shows a TEM image of the core-shell nanoparticles prepared in the Example.

Throughout this description all ranges described include all values and sub-ranges therein, unless otherwise specified.

As used herein, the words "a" and "an" and the like carry the meaning of "one or more." The phrases "selected from the group consisting of," "chosen from," and the like include mixtures of the specified materials. Terms such as "contain (s)" and the like are open terms meaning 'including at least' unless otherwise specifically noted.

The inventors have recognized that to increase magnetic core efficiency as measured in terms of core loss, the magnetic core must demonstrate a reduced measure of magnetic hysteresis as well as lowered eddy current formation. While not being constrained to theory, control of grain size to approximately that of the particle magnetic domain is believed to be a factor contributing to reduced hysteresis of the magnetic core. Moreover, as discovered and reported herein, the presence of a magnetically active metal silicate layer interfacing the insulating silica shells and the core grains significantly affects the overall magnetic properties of the core-shell nanoparticles, resulting in a marked increase in magnetic anisotropy (i.e. coercivity). Control of the $SiO_2$ shell thickness allows for control of the thickness of the metal silicate layer. The magnetic properties may then be tuned within limits by preparation of core-shell nanoparticles having differing shell thicknesses.

Thus, the first embodiment of the invention is a core-shell nanoparticle, comprising: a core of an iron cobalt ternary alloy; a shell of a silicon oxide coating the core; and a metal silicate interface in a region between the core and the shell. The third component of the ternary alloy is a transition metal selected from the group consisting of scandium, titanium, vanadium, chromium, manganese, nickel, copper and zinc. In preferred embodiments the third alloy component may be vanadium or cobalt, and most preferably the third alloy component is vanadium. The overall size of the nanoparticle may be from 1 to 200 nm, preferably 2 to 160 nm and most preferably, 3 to 30 nm.

The metal silicate of the metal silicate interface comprises at least one of iron silicate, cobalt silicate and the third component transition metal silicate, more preferably, the interface comprises iron silicate and cobalt silicate, and most preferably the interface comprises iron silicate, cobalt silicate and a silicate of the ternary metal. In highly preferred embodiments the ternary metal of the alloy is vanadium or cobalt and the metal silicate layer contains vanadium silicate or cobalt silicate.

The metal silicate of the interface layer is magnetically active and the width of the interface layer is dependent upon the width of the silica shell coating.

The width of the region of the interface is from 0.1 to 10 nm, preferably 0.1 to 5 nm. However, as described above, other widths may be preferred for achievement of core-shell nanoparticles having specific target properties.

The alloy composition is not limited and any composition conventionally known may be employed according to the present invention. Generally, the ternary component may constitute from 0.1 to 5% by molar concentration of the alloy nanoparticles.

In preferred embodiments, the ternary alloy consists of iron cobalt and vanadium and the vanadium content is 2% by molar concentration or less.

In another preferred embodiment, the ternary alloy is an iron cobalt chromium alloy and the chromium content is 1% by molar concentration or less.

The silicon oxide shell is directly coated onto the alloy nanoparticles and may of any appropriate width. In a highly preferred embodiment the silicon oxide of the shell is silicon dioxide.

The ternary alloy core shell nanoparticles according to the invention may be prepared by a process comprising:

dissolving each of an iron salt, a cobalt salt and a transition metal salt other than iron and cobalt in an alkaline alcoholic solution in the presence of a ligand to obtain a solution of the metal salts;

treating the solution with a reducing agent to produce nanoparticles of an iron cobalt ternary alloy;

coating the alloy particles with a silicon oxide shell to obtain the core shell nanoparticles and isolating and drying the produced core-shell nanoparticles.

In a preferred embodiment, the reducing agent is a metal hydride, most preferably sodium borohydride.

The alloy nanoparticles may be coated directly with a semi-conductive or non-conductive material; preferably a silicon oxide shell by dispersing the alloy nanoparticles in an aqueous solution of a trialkylamine; adding a tetraalkyl orthosilicate to the dispersion; and reacting the orthosilicate to form a silicon oxide coating on the nanoparticles.

The iron, cobalt and transition metal salts employed are not limited as long as they are soluble in the alkaline alcoholic solvent. The transition metal other than iron and cobalt is selected from the group consisting of scandium, titanium, vanadium, chromium, manganese, nickel, copper and zinc. The salts may preferably be halides, more preferably chlorides.

In highly preferred embodiments the transition metal other than iron and cobalt is vanadium or chromium and a halide salt of either vanadium or chromium is employed as the source of the metal.

The alkaline alcoholic solution comprises at least one alcohol selected from the group consisting of methanol, ethanol, n-propanol, 2-propanol, n-butanol and 2-butanol. In a preferred embodiment, the alcohol is ethanol.

Any ligand which is effective to coordinate to the metal nanoparticle surface may be employed. In a preferred embodiment, sodium citrate is the chelating agent, preferably tribasic sodium citrate. In another embodiment a tetraalkylammonium halide ligand is employed and preferably the tetraalkylammonium halide ligand is tetrabutylammonium chloride or tetraoctylammonium bromide.

Any reducing agent capable of reducing the metal ions to the metal state may be utilized. In a preferred embodiment the reducing agent is sodium borohydride.

Having generally described this invention, a further understanding can be obtained by reference to certain specific examples which are provided herein for purposes of illustration only and are not intended to be limiting unless otherwise specified.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. In this regard, the description herein is to be understood as illustrative in nature, and not as restrictive.

EXAMPLE

To a 1 L 5-neck round bottom flask was added 105 mL ethanol, 0.043 g NaOH, 1.201 g tetraoctylammonium bromide, 2.100 g iron dichloride tetrahydrate, 2.401 g cobalt dichloride hexahyrdate, and 0.0763 g vanadium trichloride. The mixture was stirred until fully dissolved. The reaction was cooled in an ice bath and placed under an inert atmosphere of argon. A solution of 2.4448 g sodium borohydride, dissolved in 90 mL ethanol, was then added slowly. The reaction was stirred for a further 10 minutes after all of the sodium borohydride solution had been added. The resulting slurry was then washed four-times with a 70/30 mixture of water and ethanol (200 mL each wash). A solution of 3.3 mL triethylamine in 126 mL of water, was added to the reaction flask. The resulting mixture was stirred for an additional 10 mins to disperse the $Fe_{49\%}Co_{49\%}V_{2\%}$ nanoparticles. 0.3 mL tetraethyl orthosilicate in 78 mL ethanol was then added and allowed to react for 10 additional minutes. This is finally washed three-times with 200 mL ethanol. The silica-coated nanoparticles were then isolated and dried.

Figure 2:
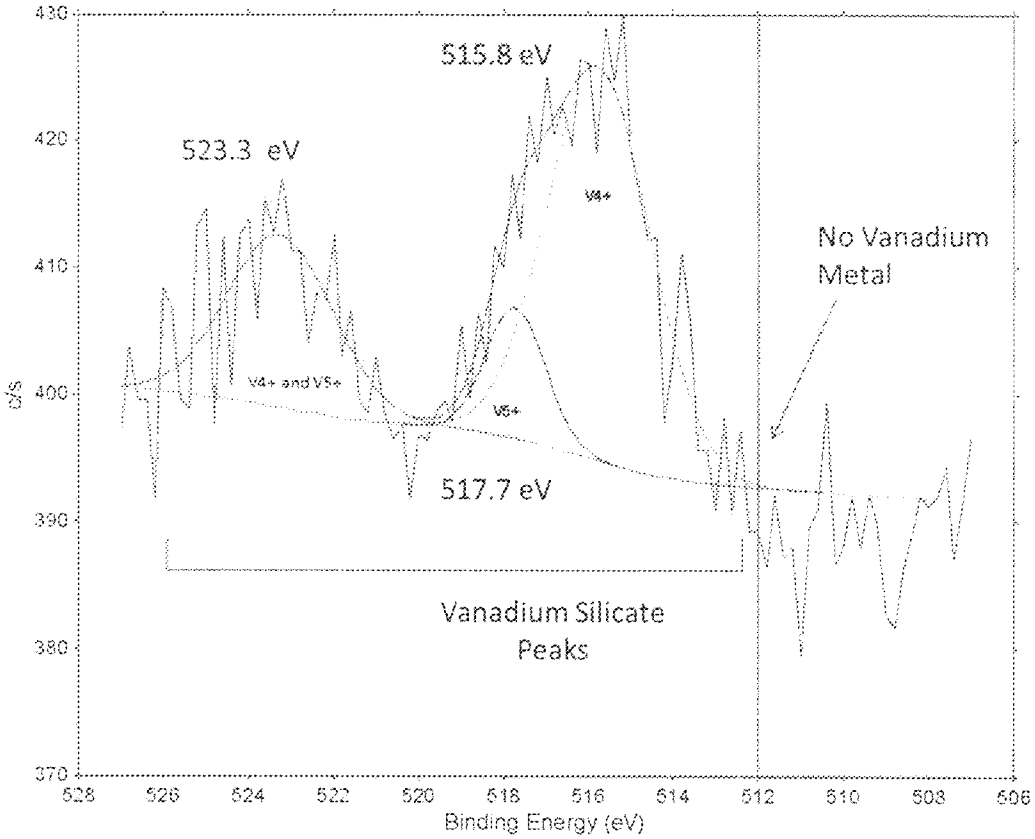
FIG. 2 shows a XPS spectrum of the core shell nanoparticles prepared in the Example which shows detail of vanadium silicate.
Figure 3:
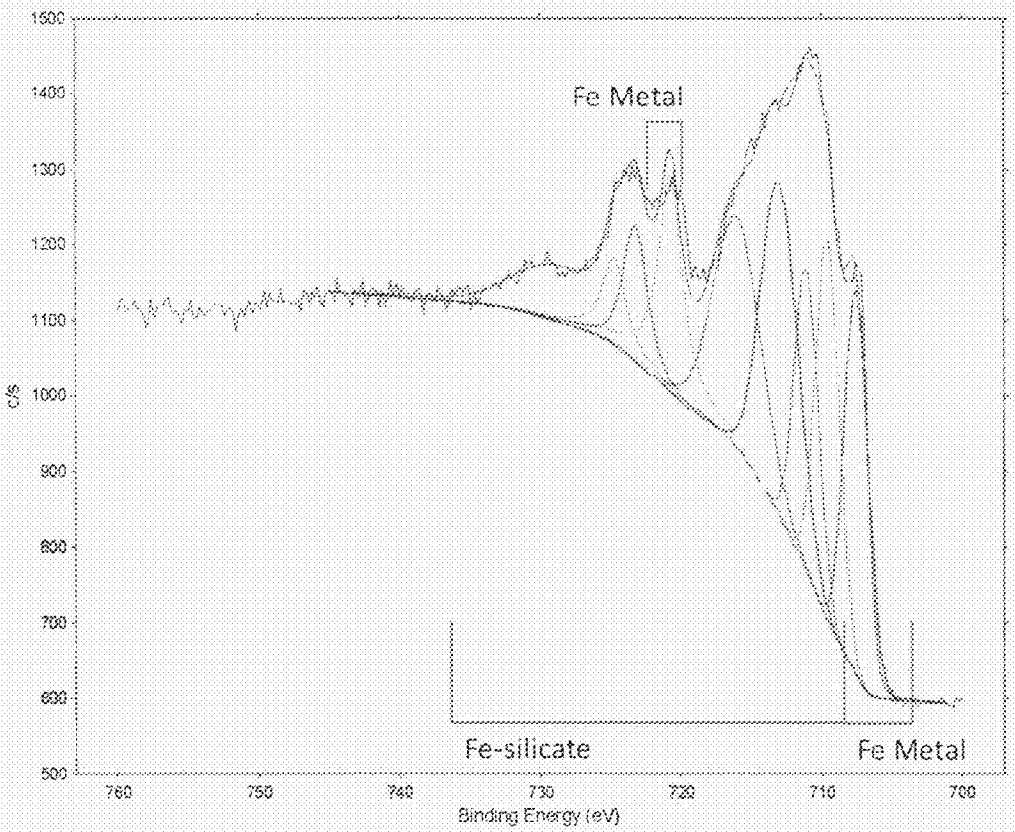
FIG. 3 shows a XPS spectrum of the core-shell nanoparticles prepared in the Example which shows detail of iron silicate.
Figure 4:
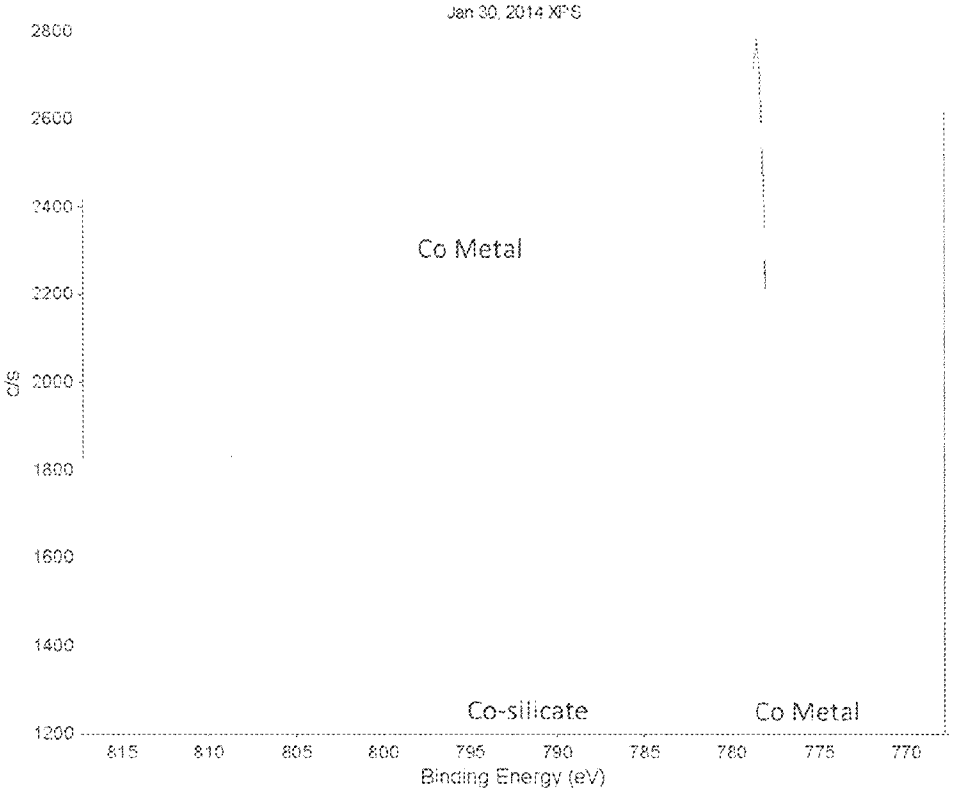
FIG. 4 shows a XPS spectrum of the core-shell nanoparticles prepared in the Example which shows detail of cobalt silicate.

The dried core-shell particles were then studied with X-ray photoelectron spectroscopy and as shown in FIGS. 2, 3 and 4 the presence of metal silicates in the FeCoV/SiO2 nanoparticles was determined.

The invention claimed is:

1. A core-shell nanoparticle, comprising:

a core of an iron cobalt ternary alloy;

a shell of a silicon oxide coating the core; and a metal silicate interface in a region between the core and the shell;

wherein the third component of the ternary alloy is a transition metal selected from the group consisting of scandium, titanium, vanadium, chromium, manganese, nickel, copper and zinc, a particle size of the nanoparticle is from 2 to 200 nm, and the metal silicate of the metal silicate interface comprises at least one of iron silicate, cobalt silicate and the third component transition metal silicate.

2. The core shell nanoparticles according to claim 1, wherein the metal silicate interface is magnetically active.

3. The core shell nanoparticles according to claim 1, wherein the metal silicate interface comprises iron silicate and cobalt silicate.

4. The core shell nanoparticles according to claim 1, wherein a width of the region of the interface is from 0.1 to 10 nm.

5. The core shell nanoparticles according to claim 1, wherein the iron cobalt ternary alloy is an iron cobalt vanadium alloy.

6. The core shell nanoparticles according to claim 1, wherein the iron cobalt ternary alloy is an iron cobalt chromium alloy.

7. The core shell nanoparticles according to claim 5, wherein the metal silicate interface comprises iron silicate, cobalt silicate and chromium silicate.

8. The core shell nanoparticles according to claim 5, wherein the metal silicate interface comprises iron silicate, cobalt silicate and vanadium silicate.

9. The core shell nanoparticles according to claim 1, wherein the silicon oxide of the shell is silicon dioxide.

10. The core-shell nanoparticles according to claim 1, wherein the particle size of the nanoparticle is from 2 to 160 nm.

11. A method to prepare the core-shell nanoparticles according to claim 1, the method comprising:

dissolving each of an iron salt, a cobalt salt and a transition metal salt in an alkaline alcoholic solution in the presence of a ligand;

treating the solution with a reducing agent to produce nanoparticles of an iron cobalt ternary alloy under an inert atmosphere;

coating the alloy particles with a silicon oxide shell to obtain the core shell nanoparticles;

isolating and drying the obtained core-shell nanoparticles.

12. The method of claim 11, wherein the reducing agent is a metal hydride.

13. The method of claim 12, wherein the metal hydride is sodium borohydride.

14. The method of claim 11, wherein coating the alloy particle comprises:

dispersing the alloy nanoparticles in an aqueous solution of a trialkylamine;

adding a tetraalkyl orthosilicate to the dispersion; and reacting the orthosilicate to form a silicon oxide coating on the nanoparticles.

15. The method of claim 11, wherein the transition metal other than iron and cobalt is selected from the group consisting of scandium, titanium, vanadium, chromium, manganese, nickel, copper and zinc.

16. The method according to claim 15, wherein the transition metal is vanadium or chromium.

17. The method according to claim 11, wherein the alkaline alcoholic solution comprises at least one selected from the group consisting of methanol, ethanol, n-propanol, 2-propanol, n-butanol and 2-butanol.

18. The method according to claim 11, wherein the ligand is a tetraalkylammonium halide.

19. The method according to claim 11, wherein the ligand is tetraoctylammonium bromide.

* * * * *